United States Patent [19]

Watts

[11] Patent Number: 4,857,711

[45] Date of Patent: Aug. 15, 1989

[54] POSITIVE TEMPERATURE COEFFICIENT HEATER

[75] Inventor: Leslie M. Watts, Elmhurst, Ill.

[73] Assignee: Illinois Tool Works Inc., Chicago, Ill.

[21] Appl. No.: 233,271

[22] Filed: Aug. 16, 1988

[51] Int. Cl.[4] ..... H05B 1/00

[52] U.S. Cl. ..... 219/548; 219/203; 219/219

[58] Field of Search ..... 219/202, 203, 219, 548, 219/549, 543, 528, 345

[56] References Cited

U.S. PATENT DOCUMENTS

| | | | |
|---|---|---|---|
| 3,790,748 | 2/1974 | VanLaethem | 219/219 |
| 3,887,788 | 6/1975 | Seibel | 219/543 |
| 4,037,286 | 7/1977 | Medearis | 219/219 |

*Primary Examiner*—A. D. Pellinen
*Assistant Examiner*—Leon K. Fuller
*Attorney, Agent, or Firm*—John O. O'Brien; Thomas W. Buckman

[57] ABSTRACT

A self regulating heating device for a mirror is disclosed including a substrate having an electrical buss system deposited on one surface including a plurality of interdigitated electrodes and two buss bars. Stripes of positive temperature coefficient resistive material are printed perpendicularly over the buss system to form a plurality of heater areas and exposed substrate areas. A first adhesive layer is deposited over the resistive layer and adheres to the exposed areas of the substrate. An electrical barrier layer is secured to the first adhesive layer and a removable protective covering is secured by the second adhesive layer. The buss bars are tapered such that the power density at any point along their length is substantially equal to the average power density of the heater areas.

10 Claims, 1 Drawing Sheet

Fig. 1
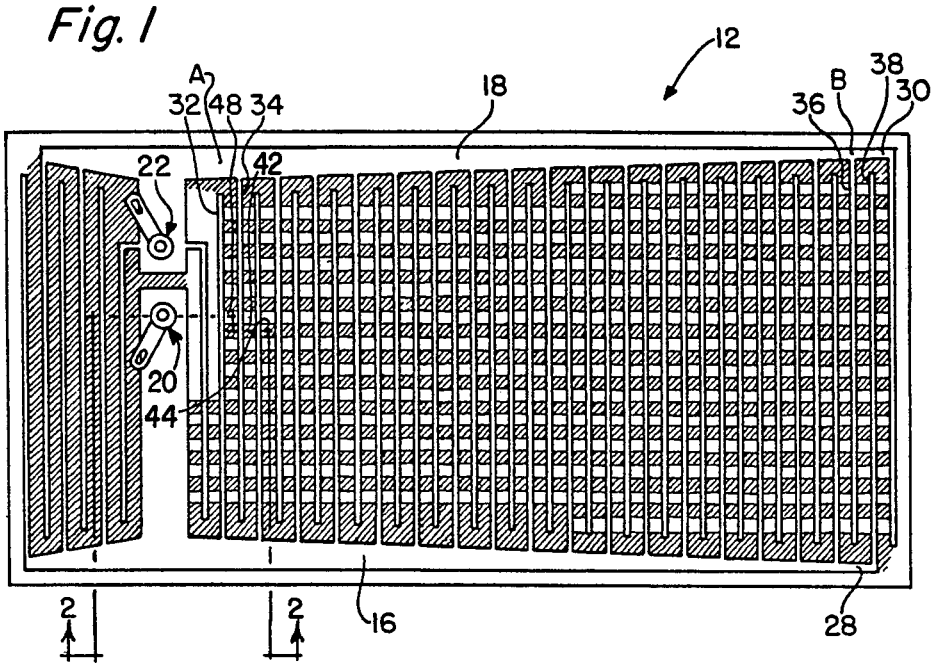
Fig. 2
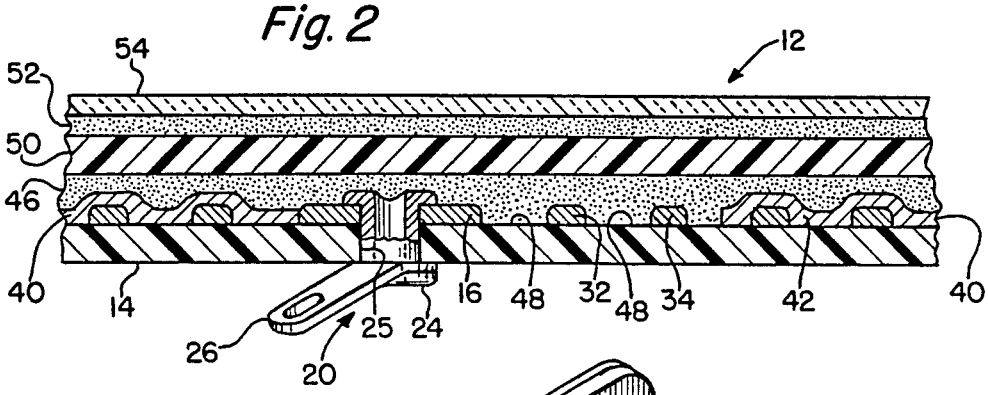
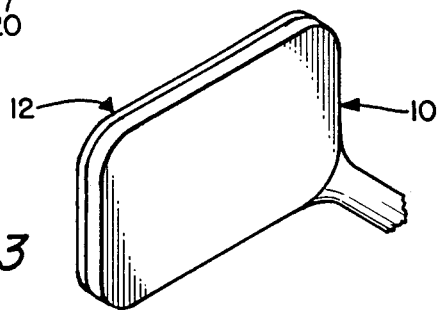
Fig. 3

POSITIVE TEMPERATURE COEFFICIENT HEATER

BACKGROUND OF THE INVENTION

This invention relates to a heating device. More particularly, the invention relates to a self regulating heating device. In still greater particularity, the invention relates to a self regulating heater using a positive temperature coefficient (PTC) resistive material specifically adapted for use in heating automotive-type outside rearview mirrors.

Heating devices for glass plates including mirrors using positive temperature coefficient materials have been devised. Two such devices are disclosed in U.S. Pat. Nos. 4,628,187 and 4,631,391. These devices have certain disadvantages and shortcomings which the present invention overcomes. For example, the device in U.S. Pat. No. 4,631,391 uses individual spaced apart platelettes of PTC heater elements sandwiched between two heat conductive layers which do not provide uniform heating of the surface to be heated. In the case of U.S. Pat. No. 4,628,187, an area principally at the periphery of the mirror occupied by the electrode material of the heating device is not heated resulting in a significant reduction in mirror heated area. Further, it should be noted that the electrode system in this device uses substantially wide, constant width silver buss bar conductor paths to carry the necessary current between the terminal connections and the electrode system. The wide conductors, not only result in significant "cold" areas of the mirror along the length of the conductors, but also requires significant quantities of the precious metal silver which significantly adds to the cost of the device.

SUMMARY OF THE INVENTION

It is accordingly the object of the invention to provide for a heating device that maximizes the surface area of a mirror that is heated and also minimizes the use of silver conductor material by optimizing the size of the conductor paths.

According to the invention, there is an electrical buss system including a pair of buss bars to which are connected interdigitated conductor paths forming a plurality of electrodes disposed on a substrate over which a plurality of parallel spaced apart stripes of positive temperature coefficient resistive material is deposited so as to form a plurality of heater areas uniformly distributed over the surface of the substrate. The buss bars are adapted to provide an electrical resistance along their length resulting in a heating effect substantially matching the heating effect of the PTC material so as to achieve heating along the buss bars and eliminating "cold" spots.

According to an important feature of the invention, the width of the PTC material stripes is varied in desired areas of the substrate so as to achieve a desired power density and thus a desired heating effect at that area.

According to the invention, the buss bars are sized such that the power density at any location along the length of each buss bar substantially matches the average power density of all of the PTC material heating areas.

According to the invention, the buss bars are decreasingly tapered from their respective power terminals toward their free ends to achieve the desired power density distribution along their length.

Advantageously, the taper to the buss bars reduces the quantity of silver conductive material required, thereby minimizing the quantity of precious silver material required and minimizing the overall cost to manufacture the heater.

BRIEF DESCRIPTION OF THE DRAWING

The invention will be better understood after reading the following Detailed Description of the Preferred Embodiment in conjunction with the drawings of which:

FIG. 1 is a plan view of the heating device showing details of construction;

FIG. 2 is a vertical transverse cross sectional view through the heating device showing further details of construction; and FIG. 3 is a perspective view of a heating device according to the invention attached to the back side of an automotive-type rearview mirror to be heated.

DETAILED DESCRIPTION OF THE PREFERRED EMBODIMENT

Shown in FIG. 3 is an automotive-type outside rearview mirror 10 having a heating device 12 according to the invention attached to a back side. The heating device 12 according to the present invention can be used in any other application where a self regulating heater is desirable. The embodiment disclosed herein however is specifically adapted for use in an automotive-type outside rearview mirror application which is subject to fogging, frosting, icing over and to being covered with snow making it desirable to have a device for overcoming such environmental effects. Further, this application is particularly suited for heating a device subject to changing ambient temperatures due to its ability to automatically control the temperature as a function of the ambient temperature. That is, at elevated ambient temperatures, no heating is required, whereas at low ambient temperatures, such as below freezing, higher temperatures are desirable.

FIGS. 1 and 2 show a preferred construction of the heating device 12. As shown in FIG. 2, the heating device comprises an electrically insulating substrate 14 of for example MYLAR of about 0.007 inches thickness. Deposited on one side of the substrate 14 is an electrical buss system, shown best in the plan view in FIG. 1. The buss system comprises a layer of printable, electrically conductive material preferably comprising an electrically conductive silver polymer such as the commercially available silver polymer 725 manufactured by Hunt Chemical. The conductive buss system layer is preferably deposited on the substrate in a thickness within the range of about 8 to 10 microns. The buss system further includes two buss bars 16, 18 each electrically connected to and extending from one of two terminals 20, 22 which each comprise an eyelet 24 secured in a hole 25 in contact with a respective one of the buss bars and a contact terminal member 26 adapted to connect to an external power supply. Each buss bar 16, 18 extends along substantially opposite portions of the peripheral edge of the substrate terminating in free ends 28, 30. Each buss bar is also tapered in decreasing area from its respective terminal connection toward its free end in a manner and for the purpose described herein below. Extending perpendicularly from each buss bar 16, 18 are a plurality of conductor paths, such as paths 32, 34, 36, 38, defining a plurality of spaced apart, parallel, interdigitated electrodes. That is, adjacent electrodes connect to opposite buss bars and extend in opposite parallel directions terminating spaced from the other buss bar.

Screen printed over the buss system is a layer of positive temperature coefficient electrically resistive material 40. The PTC material 40 is a screen printable PTC electrically conductive ink having a composition adjusted to have a desired electrical characteristic for the particular application. For example, for automotive outside rearview mirror applications, a preferred screen printable PTC material has been found to comprise an ethylene vinyl acetate co-polymer resin, such as Dupont 265 which comprises 28 percent vinyl acetate monomer and 72 percent ethylene monomer modified to have a sheet resistivity of 15,000 ohms per square. To achieve this electrical characteristic, this ethylene vinyl acetate co-polymer resin is first dissolved in an aromatic hydrocarbon solvent such as naptha, xylene or toluene at 80 degrees C. and let down to where 20 percent of the total weight of the solution is solids. Carbon black such as CABOT VULCAN PF is then added and mixed to bring the total solid content to 50 percent by weight. This material is then passed through a three roll dispersing mill having a 0.1 to 1 mil nip clearance to further disperse and crush the solids. The material is then further let down with a 20% solids resin and solvent solution until the desired sheet resistivity is achieved. As noted, the PTC material is screen printed over the buss system and substrate in parallel spaced apart stripes perpendicular to the electrode pattern, as shown in FIG. 1, and preferably in a thickness of about 2.5–5 microns so as to form a plurality of individual heating areas, such as 42, 44 on the substrate.

When a voltage is applied across the terminals and thus across the electrode array, depending upon the ambient temperature and electrical characteristics of the PTC material, current will flow through the PTC material between the electrodes causing the individual heating areas to heat. As is known, the current flow and heating effect of the PTC material depends on its temperature which will change as the ambient temperature changes and, at a predetermined temperature of the PTC material, the resistivity of the material increases causing the material to no longer conduct current, whereby the heating areas no longer generate heat. Accordingly, it can be seen that the heating device is self regulating in accordance with the surrounding ambient temperature. It should be noted that the heating effect at any location on a heater is a function of the power density at that location which can be changed by changing the width of the PTC material stripe at that location. Accordingly, it is possible to increase or decrease the heating effect at any given area of the substrate in accordance with the specific thermodynamics of the application. For example, in automotive outside rearview mirror applications, heat loss from the mirror is greatest at the perimeter. Accordingly, the width of the PTC stripes can be increased, even to the point where adjoining stripes connect together as shown in FIG. 1, so as to increase the power density and heating affect at those areas. Similarly, the width of the PTC stripes can be decreased, for example at the center of the mirror where heat loss is the least.

The buss system includes a novel buss bar configuration. The current carrying requirements of each buss bar decreases with increasing distance from the power terminals. That is, the portion of each buss bar at, for example, location A in FIG. 1 must carry all of the current requirements for all of the heating areas on the substrate, whereas at location B in FIG. 1 the buss bar only needs to carry the current requirements for the last electrode pair in the system. Accordingly, if the buss bar size is maintained constant at, for example, a size sufficient to carry the maximum current requirement at location A, there will be little, if any resistance heating of the buss bar along its length. This is particularity true at increasing distances from the power terminals toward location B. That is, the buss bar at greater distances from the terminals becomes increasingly oversized and will remain "cold" and there will be no electrical resistance heating effect in the area covered by the buss bars. The invention however, decreasingly tappers the buss bars from the power terminals to their free ends such that the power density at any location along the length of the buss bar is substantially equal to the average power density of all of the heating areas on the substrate. In this manner, the electrical resistance created by the sized buss bar, will create a heating effect substantially the same as that created by the heating areas. It should be noted that one skilled in the art knowing the electrical characteristic of the PTC material, conductive silver and voltage available at the power terminals can readily calculate the average power density of the heater areas and thus the buss bar size at all locations required to achieve the average power density at all locations along its length. Accordingly, the entire substrate from the center out to the periphery, including those areas beneath the buss bars, will be heated with substantially no cold spots. It can be appreciated therefore that substantially the entire surface area of the mirror will be heated. Another advantage of the tapered buss bar is that the quantity of silver required is minimized with the corresponding cost savings.

Referring to FIG. 2, a layer of acrylic pressure sensitive adhesive 46 is deposited over the PTC material. Because the PTC material is deposited in stripes, the adhesive is able to flow down to and adhere to the exposed substrate areas 48 in the spaces between adjacent stripes of PTC material. The adhesive adheres significantly better to the MYLAR substrate than to the PTC material and the integrity of the bond is significantly increased. A second insulating barrier layer 50 of MYLAR of about 0.001 inch in thickness is secured by the adhesive layer 46 and functions to environmentally seal the conductor and PTC material and to electrically insulate the conductors from possible shorting or arcing to the member on which it is mounted. For example, without the barrier layer 50, the conductors could come into contact with or arc to a silver backing on the mirror.

Another adhesive layer 52 is deposited on the barrier layer 50 and a removable protective covering 54, such as paper, is retained to the adhesive layer 52. To mount the heater on a mirror, the protective covering 54 is peeled off, the device is secured to the back of the mirror by the adhesive 52 and the power source is connected across the terminals 20, 22.

Having described the preferred embodiment of the invention those skilled in the art having the benefit of the description and the accompanying drawings can readily devise other embodiments and modifications and such other embodiments and modifications are to be considered to be within the scope of appended claims.

What is claimed is:

1. A heating device comprising:

a planer electrically insulative substrate;

an electrical buss system on one surface of said substrate, including a pair of buss bars and two electrode patterns having a plurality of spaced apart parallel interdigitated electrodes, adjacent electrodes of said plurality of interdigitated electrodes connect to different ones of said pair of buss bars, each buss bar extending from one of a pair of terminal connection points along generally opposite portions of a peripheral edge of said substrate;

an electrically resistive layer of material having a positive temperature coefficient, and resistive layer deposited over said electrical buss system in a plurality of parallel spaced apart stripes orientated perpendicular to said interdigitated electrodes defining a plurality of heater areas between adjacent electrodes;

a first adhesive layer deposited over said electrically resistive layer including the spaces between said spaced apart stripes, whereby said adhesive layer contacts and adheres to said substrate in areas of said substrate between said heater areas;

an electrically insulative barrier layer on said adhesive layer;

a second adhesive layer on said electrically insulative barrier layer; and means providing for achieving a predetermined power density at any location along each of said buss bars from said respective terminal connection point to a free end of each buss bar substantially equal to an average power of all of said heater areas.

2. The heating device as defined in claim 1 further including a removable protective layer on said second adhesive layer.

3. The heating device as defined in claim 1 wherein said means for achieving said predetermined power density includes each said buss bar being decreasingly tapered from said respective terminal connection point to said free end.

4. The heating device as defined in claim 1 wherein predetermined ones of said stripes of resistive material have a width at predetermined locations on said one surface of said substrate to form heating areas having predetermined power densities at said predetermined locations.

5. The heating device as defined in claim 4 wherein said stripes of resistive material at least along a portion of the peripheral edge of said substrate have widths greater than the widths of the other of said plurality of stripes of resistive material.

6. A heating device comprising:

a planer insulating substrate having a peripheral edge;

an electrical buss system deposited on one surface of said substrate, said buss system including two buss bars extending along generally opposite portions of the peripheral edge of said substrate, a plurality of parallel spaced apart interdigitated electrodes alternately connected to said buss bars defining a plurality of electrode paths;

a layer of positive temperature coefficient resistive material disposed over said buss system in a pattern including a plurality of spaced apart stripes of said material oriented substantially perpendicular to said electrode paths defining a plurality of heating areas between adjacent electrode paths and a plurality of exposed areas of said substrate between said stripes of resistive material;

each said buss bar decreasingly tapers in width from a terminal connection point to each buss bar to a free end distal from each respective terminal connection wherein said taper is adapted to provide a power density at any location along the length of each said buss bar substantially equal to an average power density of all of said heater areas; and at least one adhesive layer deposited over said positive temperature coefficient resistive material adhered to said exposed areas of said substrate.

7. The heating device as defined in claim 6 further including an electrically insulating layer secured to said at least one adhesive layer and a second adhesive layer deposited over said electrically insulating layer.

8. The heating device as defined in claim 7 further including a removable protective covering on said second adhesive layer.

9. The heating device as defined in claim 6 wherein the width of said stripes of resistive material at predetermined locations on said one surface of said substrate define a desired power density at said predetermined locations, whereby a desired heating effect is provided at each predetermined location.

10. A planer heating device for attachment to a member to be heated comprising:

an electrically insulating substrate having a predetermined shape conforming to the member to be heated;

a conductor array deposited on said substrate including two buss bars and a plurality of spaced apart elongated interdigitated conductors extending from said buss bars;

a positive temperature coefficient resistive material deposited over said conductor array in a plurality of parallel spaced apart stripes disposed perpendicular to said interdigitated conductors forming a plurality of heating areas having an average power density;

said buss bars adapted to provide for a power density at any location along their length substantially equal to the average power density of said plurality of heating areas;

a first adhesive layer disposed over said positive temperature coefficient resistive material and areas between said stripes of positive temperature coefficient resistive material;

an electrically insulating layer secured to said first adhesive layer;

a second adhesive layer on said electrically insulating layer; and a protective covering removably secured by said second adhesive layer.

* * * * *